US007043185B2

(12) United States Patent
Yoshikawa

(10) Patent No.: US 7,043,185 B2
(45) Date of Patent: May 9, 2006

(54) FIXING APPARATUS AND IMAGE FORMING APPARATUS FOR FIXING A TONER IMAGE ON A RECORDING MEDIUM

(75) Inventor: Takahiro Yoshikawa, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 37 days.

(21) Appl. No.: 10/441,006

(22) Filed: May 20, 2003

(65) Prior Publication Data

US 2003/0231893 A1 Dec. 18, 2003

(30) Foreign Application Priority Data

May 20, 2002 (JP) ..... 2002-145508
Apr. 14, 2003 (JP) ..... 2003-109535

(51) Int. Cl.
*G03G 15/20* (2006.01)

(52) U.S. Cl. ..... 399/329; 399/67

(58) Field of Classification Search ..... 399/328–331, 399/338, 335, 69, 67; 219/216, 469–471
See application file for complete search history.

(56) References Cited

U.S. PATENT DOCUMENTS 4,977,431 A 12/1990 Fuji
5,402,211 A 3/1995 Yoshikawa
5,450,182 A * 9/1995 Wayman et al. ..... 399/328
5,508,797 A * 4/1996 Tonai et al. ..... 399/335
5,729,812 A * 3/1998 Moser ..... 399/329
5,850,588 A 12/1998 Yoshikawa
5,903,799 A * 5/1999 Saito et al. ..... 219/216
6,137,984 A * 10/2000 Higashi et al. ..... 399/329
6,160,974 A 12/2000 Yoshikawa et al.
6,327,444 B1 * 12/2001 Hachisuga ..... 399/329
6,333,490 B1 * 12/2001 Higashi et al. ..... 219/216
6,496,666 B1 * 12/2002 Hayashi et al. ..... 399/329
6,501,914 B1 12/2002 Yoshikawa
6,564,026 B1 * 5/2003 Uehara ..... 399/329
6,580,894 B1 * 6/2003 Kobashigawa ..... 399/329
6,594,464 B1 * 7/2003 Hayashi et al. ..... 399/329
6,782,233 B1 * 8/2004 Condello et al. ..... 399/329
2002/0085851 A1 * 7/2002 Murata et al. ..... 399/70

FOREIGN PATENT DOCUMENTS

JP 60-87377 5/1985

(Continued)

OTHER PUBLICATIONS

U.S. Appl. No. 09/764,261, filed Jan. 19, 2001, Yoshikawa.

(Continued)

*Primary Examiner*—Susan Lee
(74) *Attorney, Agent, or Firm*—Oblon, Spivak, McClelland, Maier & Neustadt, P.C.

(57) ABSTRACT

An image forming apparatus includes a first heater that heats a heating member, a second heater that heats a support member, and a third heater that heats a facing member. The image forming apparatus further includes a fixing belt wound around between the heating member and the support member, and a facing member arranged so as to face the fixing belt. A paper is passed through a nip portion between the facing member and the fixing belt and a toner image is fixed on the paper by applying heat and pressure to the toner of the toner image. Only the first heater is energized during the fixing operation. All the three heaters are energized at the time of startup operation and during a standby state.

19 Claims, 6 Drawing Sheets

FOREIGN PATENT DOCUMENTS

| | | |
|---|---|---|
| JP | 1-237585 | 9/1989 |
| JP | 5-333728 | 12/1993 |
| JP | 05-333728 | 12/1993 |
| JP | 6-67563 | 3/1994 |
| JP | 06-067563 | 3/1994 |
| JP | 11-344897 | 12/1999 |
| JP | 2001-117412 | 4/2001 |
| JP | 2002-49267 | 2/2002 |
| JP | 2002-123111 | 4/2002 |

OTHER PUBLICATIONS

U.S. Appl. No. 10/737,851, filed Dec. 18, 2003, Hasegawa.
U.S. Appl. No. 10/873,132, filed Jun. 23, 2004, Yoshikawa.
U.S. Appl. No. 11/175,291, filed Jul. 7, 2005, Yoshikawa.

* cited by examiner

FIXING APPARATUS AND IMAGE FORMING APPARATUS FOR FIXING A TONER IMAGE ON A RECORDING MEDIUM

BACKGROUND OF THE INVENTION

1) Field of the Invention

The present invention relates to a technology for fixing a toner image on a recording medium by applying heat and pressure to the toner on the toner image during passage of the recording medium through a nip portion between a fixing belt that rotates and a facing member provided so as to face the fixing belt.

2) Description of the Related Art

An image forming apparatus is constituted as a digital copier, a printer, a facsimile, or a multifunction machine having at least two functions of these devices. The image forming apparatus conventionally adopts a fixing apparatus of the type described above. In this type of fixing apparatus, the heat capacity of the fixing belt used for the fixing apparatus can be made relatively small. Therefore, when the fixing apparatus is started up, it is possible to reduce a time required for increasing the temperature of the fixing belt to a fixing temperature suitable for fixing the toner image.

This type of fixing apparatus can be classified roughly into those as follows. That is, (1) a first type of fixing apparatus having first to third heaters that heat a heating member around which an endless fixing belt is wound, a support member, and the facing member, respectively, (2) a second type of fixing apparatus having one heater disposed inside a heating member, and the other heater(s) disposed inside either one of a support member and a facing member, or disposed inside both of the support member and the facing member, and (3) a third fixing apparatus having one heater that heats a fixing belt, and the other heater(s) disposed inside either one of a support member and a facing member, or disposed inside both of the support member and the facing member.

Conventionally, in any type of the fixing apparatuses, the rate of power supplied to the respective heaters is always constant. With such a configuration, for example, a defect described below may come up.

In the first type of fixing apparatus, the first to third heaters are energized and supplied with power at a certain rate at the time of fixing operation, and are controlled so that the temperature of the fixing belt and the facing member is increased to a fixing temperature suitable for fixation of the toner image. Further, at the time of startup and during a standby state of the fixing apparatus, power is supplied to the first to third heaters at a certain rate. However, in such a control mode, when a recording medium passes through the nip portion between the fixing belt and the facing member during the fixing operation, much of the heat of the fixing belt is taken away by the recording medium, thereby the temperature of the fixing belt rapidly decreases. Therefore, even if the fixing belt is heated by the first to third heaters, the temperature of the fixing belt is not restored in time and becomes lower than the fixing temperature suitable for fixing the toner image, thereby insufficient fixing may be caused. Such a defect similarly occurs in the second and third types of fixing apparatus.

SUMMARY OF THE INVENTION

It is an object of the present invention to solve at least the problems in the conventional technology.

The fixing apparatus according to one aspect of this invention includes a heating member, a support member, a fixing belt wound around between the heating member and the support member, and a facing member arranged so as to face the fixing belt. The fixing apparatus also includes a first heater that heats the heating member, a second heater that heats the support member, and a third heater that heats the facing member. A recording medium is passed through a nip portion between the facing member and the fixing belt that rotates, and a toner image is fixed on the recording medium by applying heat and pressure to toner on the toner image during the passage of the recording medium through the nip portion. At the time of fixing operation, only the first heater is energized, of the first to third heaters, and all the first to third heaters are energized at the time of startup operation and during a standby state.

The fixing apparatus according to another aspect of this invention includes a heating member, a support member, a fixing belt wound around between the heating member and the support member, and a facing member arranged so as to face the support member via the fixing belt. The fixing apparatus also includes a first heater disposed inside the heating member, and a second heater disposed inside either of the support member and the facing member, or disposed inside both of the support member and the facing member. A recording medium is passed through a nip portion between the facing member and the fixing belt that rotates, and a toner image is fixed on the recording medium by applying heat and pressure to toner on the toner image during the passage of the recording medium through the nip portion. A rate of power supplied to the second heater with respect to power supplied to the first heater can be changed.

The fixing apparatus according to still another aspect of this invention includes a support member, a fixing belt wound around between at least two support members, and a facing member arranged so as to face the support members via the fixing belt. The fixing apparatus also includes a first heater that heats the fixing belt, and a second heater disposed inside either one of the support member and the facing member, or disposed inside both of the support member and the facing member. A recording medium is passed through a nip portion between the facing member and the fixing belt that rotates, and a toner image is fixed on the recording medium by applying heat and pressure to toner on the toner image during the passage of the recording medium through the nip portion. A rate of power supplied to the second heater with respect to power supplied to the first heater can be changed.

The image forming apparatus according to still another aspect of this invention includes any one of the fixing apparatuses.

The other objects, features and advantages of the present invention are specifically set forth in or will become apparent from the following detailed descriptions of the invention when read in conjunction with the accompanying drawings.

DETAILED DESCRIPTION

An embodiment of the present invention is explained in detail below with reference to the accompanying drawings.

Figure 1:
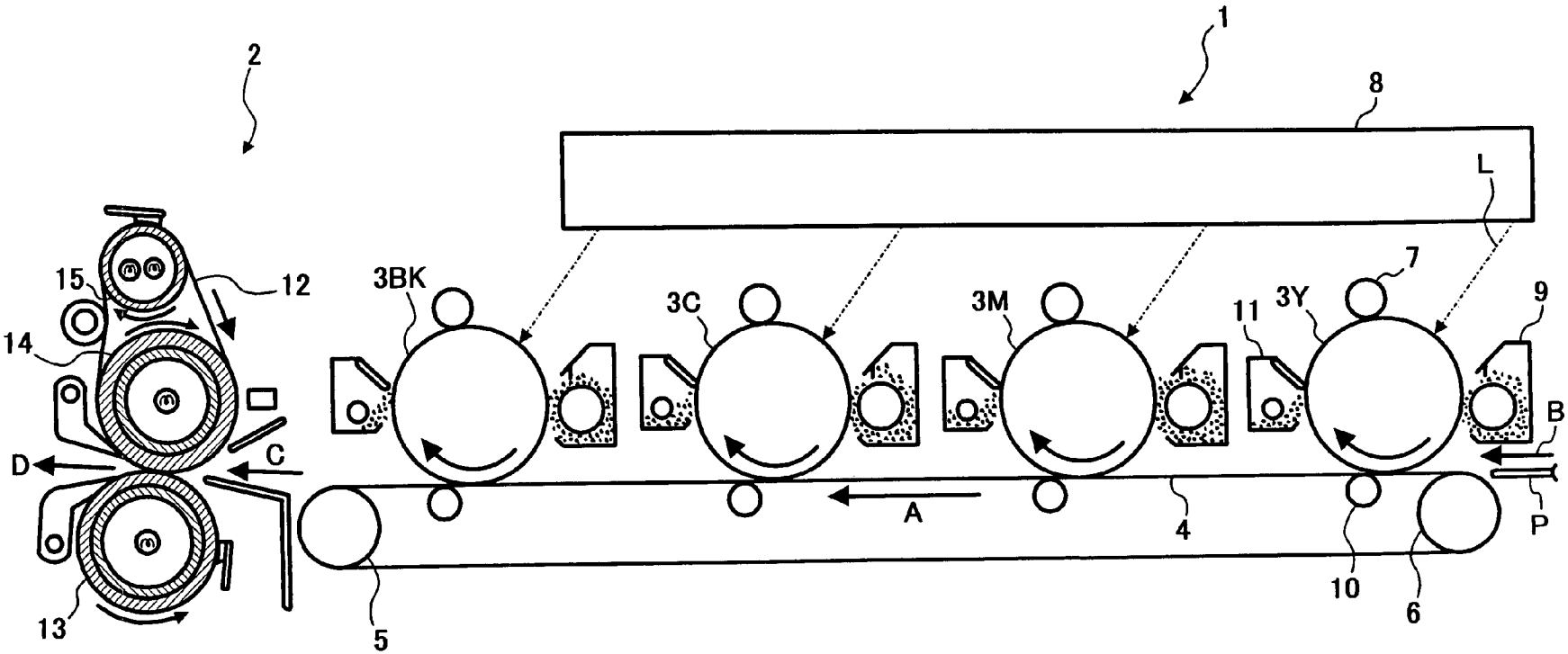
FIG. 1 is a schematic diagram of one example of an image forming apparatus.

FIG. 1 is a partial cross section of an image forming apparatus. The image forming apparatus has an image forming unit 1 that forms a toner image on a recording medium, and a fixing apparatus 2 that fixes the toner image on the recording medium so as to enable formation of a full color image on the recording medium. This image forming apparatus is constituted as a digital copier, a printer, a facsimile, or a multifunction machine thereof. The schematic configuration of the image forming unit 1 will be explained below.

The image forming unit 1 shown in FIG. 1 has first to fourth image carriers 3Y, 3M, 3C, and 3BK each formed as a photoreceptor drum, and a yellow toner image, a magenta toner image, a cyan toner image, and a black toner image are respectively formed on the image carriers. A transfer belt 4 is arranged facing the first to fourth image carriers 3Y to 3BK, and the transfer belt 4 is wound between a drive roller 5 and a driven roller 6, and rotated in a direction of arrow A.

Since the configuration and the effect for forming the toner image on the respective first to fourth image carriers 3Y, 3M, 3C, and 3BK are substantially the same, only the configuration for forming the toner image on the first image carrier 3Y is explained. This image carrier 3Y is rotated in the clockwise direction in FIG. 1, and the image carrier 3Y is charged in a predetermined polarity by a charging roller 7 during the rotation. Subsequently, an optically modulated laser beam L emitted from a laser write unit 8 is irradiated on the charged surface. As a result, an electrostatic latent image is formed on the image carrier 3Y, and the formed electrostatic latent image is visualized as a yellow toner image by a developing unit 9.

On the other hand, a recording medium P in a sheet form such as a transfer paper, a resin sheet, or a resin film is sent out from a paper feeder (not shown) arranged in the bottom part of the body of the image forming apparatus. The recording medium P is fed to between the image carrier 3Y and the transfer belt 4 in a direction shown by arrow B, and is transferred on the transfer belt 4. A transfer unit 10 is disposed at a position substantially facing the image carrier 3Y via the transfer belt 4, and a voltage of a polarity opposite to the polarity of the charged toner on the image carrier 3Y is applied to the transfer unit 10. As a result, the yellow toner image on the image carrier 3Y is transferred onto the recording medium P. The residual toner after transfer, which is not used for the transfer and remains on the image carrier 3Y, is removed by a cleaning unit 11.

Similarly, a magenta toner image, a cyan toner image, and a black toner image are respectively formed on the second to fourth image carriers 3M, 3C, and 3BK, and these toner images are sequentially and superposedly transferred on the recording medium P on which the yellow toner image has been transferred, to thereby form a composite toner image on the recording medium P.

The recording medium P carrying the four-color unfixed composite toner image is fed to the fixing apparatus 2, as shown by arrow C. When passing through the fixing apparatus 2, the toner image is fixed on the recording medium P, and a full color image is obtained. The recording medium having passed through the fixing apparatus 2 is carried as shown by arrow D, and ejected to a paper ejector (not shown).

It is also possible to form a toner image only on a part of the image carriers, instead of forming the respective color toner images on all of the first to fourth image carriers 3Y, 3M, 3C, and 3BK, to transfer the toner image on the recording medium P, and fix the toner image by the fixing apparatus 2. As explained above, the image forming apparatus shown in FIG. 1 is constituted so as to transfer the composite toner image obtained by superposing toner images of a plurality of colors on the recording medium or transfer a single color toner image on the recording medium, and to fix the toner image by the fixing apparatus 2.

Further, in the image forming apparatus, it is also possible to carry the recording medium P to an intermediate paper feeder (not shown), without ejecting the recording medium P output from the fixing apparatus 2, to the paper ejector, then feed the recording medium to the transfer belt 4 again as shown by the arrow B, transfer the toner image from the image carrier on a surface opposite to the surface on which the toner image has been transferred, while supporting and carrying the recording medium on the transfer belt 4, fix the toner image by the fixing apparatus 2, and eject the recording medium P to the paper ejector.

Figure 2:
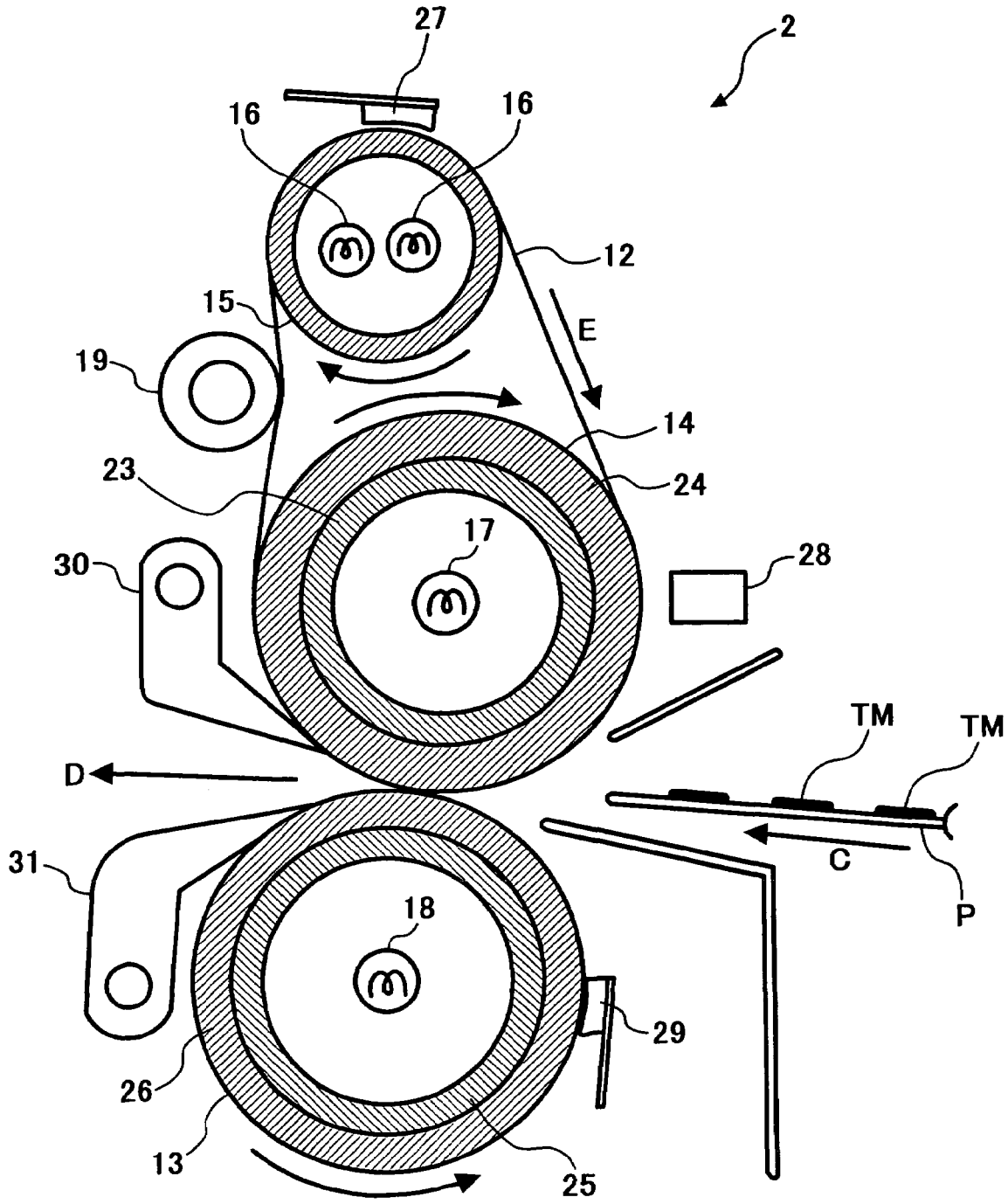
FIG. 2 is an enlarged cross section of a fixing apparatus shown in FIG. 1.

FIG. 2 is an enlarged cross section of the fixing apparatus 2 shown in FIG. 1. This fixing apparatus 2 includes a fixing belt 12 formed with an endless belt wound around on a heating roller 15 as an example of a heating member and a support roller 14 as an example of a support member, and a facing roller 13 as an example of the facing member arranged so as to face the fixing belt 12. A tension roller 19 is pressed against the fixing belt 12 so as to impart an appropriate tension to the fixing belt 12.

The facing roller 13 is pressed against the fixing belt 12, to thereby form a nip portion between the fixing belt 12 and the facing roller 13. In the fixing apparatus 2 shown in FIG. 2, a facing member formed with the facing roller 13 is arranged so as to face the support member formed with the support roller 14 via the fixing belt 12. More specifically, the facing roller 13 is pressurized with respect to the support roller 14 via the fixing belt 12 by a pressurizing member (not shown), thereby the fixing belt 12 is pressed against the facing roller 13. Instead of such a configuration, the facing roller 13 may be pressed against a portion of the fixing belt that does not come in contact with the support roller 14, or the facing roller 13 may be pressed against over a portion of the fixing belt that comes in contact with the support roller 14 and the portion of the fixing belt that does not come in contact with the support roller 14.

The fixing belt 12 is formed with an endless belt obtained by providing a silicone rubber on a base material comprising a metal alloy such as stainless steel (SUS) containing nickel, or a base material comprising a resin film such as polyimide (PI) or polyamide-imide (PAI), and providing a surface layer comprising a fluororesin on the surface of the rubber.

The support roller 14 is a hollow roller obtained by providing an elastic layer 24 consisting of a silicone rubber on the surface of a cylindrical core metal 23, and providing a surface layer comprising a fluororesin on the surface of the elastic layer. The facing roller 13 is also constituted of a hollow roller obtained by providing an elastic layer 26 consisting of a silicone rubber on the surface of a cylindrical core metal 25, and providing a surface layer comprising a fluororesin on the surface of the elastic layer. The heating roller 15 is formed of, for example, a hollow metal pipe.

The fixing apparatus 2 has a first heater 16 that heats the heating member, a second heater 17 that heats the support member, and a third heater 18 that heats the facing member. In the shown example, the heaters 16, 17, and 18 are respectively arranged inside the heating roller 15, the support roller 14, and the facing roller 13. The first heater 16 is arranged inside the heating member, the second heater 17 is arranged inside the support member, and the third heater 18 is arranged inside the facing member.

As the heaters 16, 17, and 18, a heater that generates heat by being energized can be used. In the fixing apparatus 2 shown in FIG. 2, the first heater 16 includes two heaters, and each of the second and third heaters 17 and 18 includes one heater, but the number of heaters can be appropriately changed. Alternatively, instead of using such a heater, a heater formed with an induction heating coil that is provided inside or outside the respective rollers 13, 14, and 15 may be used to heat the respective rollers 13, 14, and 15 by energizing the coil, thus warming the fixing belt 12.

As shown in FIG. 2, a first temperature sensor 27 is provided on the surface of the portion of the fixing belt that is in contact with the heating roller 15, a second temperature sensor 28 is provided on the surface of the portion of the fixing belt that is in contact with the support roller 14, and a third temperature sensor 29 is provided on the surface of the facing roller 13 so as to face these surfaces. The temperatures on the respective surfaces of the fixing belt and the surface of the facing roller 13 are detected. Energization to the respective heaters 16, 17, and 18 is controlled based on the detection result. At this time, the respective temperature sensors can be selectively used in such a manner that the first and second temperature sensors 27 and 28 detect the temperatures on the surfaces of the fixing belt when the fixing belt 12 is rotating as described later, and that only the second temperature sensor 28 detects the temperatures on the surfaces of the fixing belt when the fixing belt 12 halts.

At the time of fixing operation, the heating roller 15, the support roller 14, and the facing roller 13 rotate respectively in the directions shown by arrows in FIG. 2, and the fixing belt 12 is rotated in a direction of arrow E. On the other hand, as shown in FIG. 2, the recording medium P carrying an unfixed toner image TM is fed to the fixing apparatus 2 as shown by arrow C, as explained with reference to FIG. 1. The toner image TM passes through the nip portion between the fixing belt 12 and the facing roller 13, while coming in contact with the heated fixing belt 12. During the passage, the heat and pressure are applied to the toner on the toner image to fuse the toner, and the toner image is fixed on the recording medium P. The recording medium P having passed through the nip portion is further carried and ejected to the paper ejector.

In the example shown in FIG. 2, the elastic layers 24 and 26 of the support roller 14 and the facing roller 13 are brought into press contact with each other via the fixing belt 12, and these elastic layers 24 and 26 elastically deform to form the nip portion between the fixing belt 12 and the facing roller 13, through which the recording medium P passes. In this manner, the elastic layers 24 and 26 are provided on the surface side of the support roller 14 and the facing roller 13 in order to form the nip portion. However, the Young's modulus of the elastic layers 24 and 26 is smaller than that of the heating roller 15 formed of a metal pipe. Further, the elastic layers 24 and 26 consisting of, for example, silicone rubber have a lower thermal conductivity than that of the heating roller 15 formed of the metal pipe. Therefore, an averaged thermal conductivity of the whole heating member (the heating roller 15 in the illustrated example) is set larger than the averaged thermal conductivity of the whole support member (the support roller 14 in the illustrated example) and the averaged thermal conductivity of the whole facing member (the facing roller 13 in the illustrated example).

Separation assisting units 30 and 31 are respectively provided in order to prevent the recording medium coming out from the nip portion from adhering on the fixing belt 12 or the facing roller 13. The adhesion may be caused by fused toner on the recording medium P while the recording medium is passing through the nip portion. Further, at least one of the heating member, the support member, and the facing member may be constituted of a non-rotatable member so that the rotating fixing belt comes in contact with the non-rotatable member in a sliding manner.

As described above, the fixing apparatus is constituted such that it allows the recording medium carrying the toner image that is fixed to pass through the nip portion between the facing member and the fixing belt that rotates and that heat and pressure are applied to the toner on the toner image, to thereby fix the toner image on the recording medium.

At the time of fixing operation, the fixing belt 12 rotates as described above, and the recording medium P whose temperature is adjusted to the ambient temperature passes through the nip portion between the fixing belt 12 and the facing roller 13. During the passage, the heat of the fixing belt 12 given to the recording medium, is taken away by the recording medium, and the temperature of the fixing belt 12 decreases. Particularly, when a plurality of recording media continuously passes through the nip portion, the temperature of the fixing belt 12 considerably decreases.

At that time, as in the conventional fixing apparatus, if all of the first to third heaters 16, 17, and 18 are energized to control ON and OFF of power supply to the respective heaters 16, 17, and 18 so that the temperature of the fixing belt 12 is set to a fixing temperature suitable for fixation of the toner image, the heat discharged from the second and third heaters 17 and 18 cannot be transmitted quickly to the fixing belt 12. That is because the thermal conductivity of the support roller 14 and the facing roller 13 is low and the second and third heaters 17 and 18 are arranged inside the rollers 14 and 13. Hence, the temperature of the fixing belt 12 cannot be raised to the fixing temperature immediately. On the other hand, the heat discharged from the first heater 16 provided in the heating roller 15 can be transmitted to the fixing belt 12 in a short period of time, since the heating roller 15 has a high thermal conductivity. Therefore, if the fixing apparatus is configured such that much of the heat is discharged from the first heater 16, a drop in temperature of the fixing belt 12 due to passage of the recording medium through the nip portion can be immediately restored, and the temperature of the fixing belt 12 can be maintained at any time at the fixing temperature suitable for fixation of the toner image.

From this point of view, only the first heater 16 of the first to third heaters 16, 17, and 18 is energized at the time of fixing operation in the fixing apparatus 2 in this example, and the ON and OFF of the first heater 16 is controlled so that the temperature of the fixing belt 12 becomes a target temperature at the time of fixation, and therefore the temperature of the fixing belt 12 is maintained at the fixing temperature suitable for fixation of the toner image. According to this configuration, the whole allowable power to be used by the heaters of the fixing apparatus 2 can be supplied to the first heater 16. That is, the allowable maximum power is supplied to the first heater 16, to thereby quickly recover a drop in temperature of the fixing belt 12 due to the passage of the recording medium P. Thus, the temperature of the fixing belt 12 can be maintained within the fixing temperature at any time. For example, if it is assumed that the target temperature of the fixing belt 12 at the time of fixing operation is 180° C., then the allowable maximum power is supplied to the first heater 16 at the time of ON, while controlling ON and OFF of the first heater 16 so that the temperature of the fixing belt 12 becomes the target temperature. Thus, the temperature of the fixing belt 12 can be maintained at the fixing temperature in the vicinity of the target temperature. In this case, it is also possible to construct the fixing apparatus such that when energization to the first heater 16 is cut off, the second and third heaters 17 and 18 are energized so as to warm the support roller 14 and the facing roller 13.

The time of fixing operation of the fixing apparatus includes a period of time since the rear end of a preceding recording medium comes out from the nip portion between the fixing belt 12 and the facing roller 13 until the tip of the subsequent recording medium enters into the nip portion when a plurality of recording media is fed continuously to the nip portion with a certain interval therebetween, in addition to the time when the recording medium is passing through the nip portion.

On the other hand, the recording medium does not pass through the nip portion in a standby mode in which the heating roller 15, the support roller 14, the facing roller 13, and the fixing belt 12, which are at rest, start to rotate if the recording medium is fed to the nip portion. More specifically, in this case, the rollers 13, 14, and 15 and the fixing belt 12 start to rotate at the time at which the tip of the recording medium reaches the nip portion or slightly before the nip portion, and are ready to immediately perform the fixing operation of the toner image. In such a case, the heat of the fixing belt 12 is not taken away by the recording medium. Therefore, the temperature of the fixing belt 12 can be maintained at a temperature in the vicinity of the target temperature in the standby mode by less amount of heat supplied from the first heater 16. Further, if the temperatures of the support roller 14 and the facing roller 13 drop largely during the standby state, the heat of the fixing belt 12 is taken away by the facing roller 13 and the support roller 14 when the rollers 13, 14, and 15 and the fixing belt 12 start to rotate, and hence the temperature of the fixing belt 12 drops largely than the target temperature, thereby the temperature thereof cannot be kept at the fixing temperature. This also applies to the case of startup operation that is from the point in time when the power of the image forming apparatus is turned on and power supply to the heater is started until the temperatures of the fixing belt 12 and the facing roller 13 reach the respective target temperatures at the time of fixing operation. Further, the above problem applies to the case of startup operation that is from the point in time when power supply to the heaters 16, 17, and 18 is started after the power supply is suspended for a long period of time due to jam of the recording medium until the temperatures of the fixing belt 12 and the facing roller 13 are increased to the respective target temperatures at the time of fixing operation. The target temperature of the fixing belt during the standby state is set to slightly higher or slightly lower than the target temperature of the fixing belt 12 at the time of fixing operation, or set to the same temperature as the target temperature.

From this point of view, the fixing apparatus 2 in this example is configured such that all of the first to third heaters 16, 17, and 18 are energized at the time of startup operation and at the time of standby. For example, at the time of standby, all of the first to third heaters 16, 17, and 18 are energized, and ON and OFF of power supply is controlled so that the temperatures of the fixing belt 12 and the facing roller 13 reach the target temperatures at the time of standby.

With such a configuration, at the time of standby or startup operation, the power that can be supplied to the heaters can be distributed to the respective heaters 16, 17, and 18 to heat the rollers 13, 14, and 15 and the fixing belt 12. Therefore, when the rollers 13, 14, and 15 and the fixing belt 12 start to rotate, much of the heat of the fixing belt 12 is not taken away by the facing roller 13 and the support roller 14, and therefore the temperature of the fixing belt 12 does not drop largely.

Distribution of power to the first to third heaters 16, 17, and 18 can be performed by controlling the energizing time of the heaters as described below. Alternatively, if there is a plurality of heaters, only one heater of the heaters can be energized like the first heater 16 shown in FIG. 7.

Figure 3:
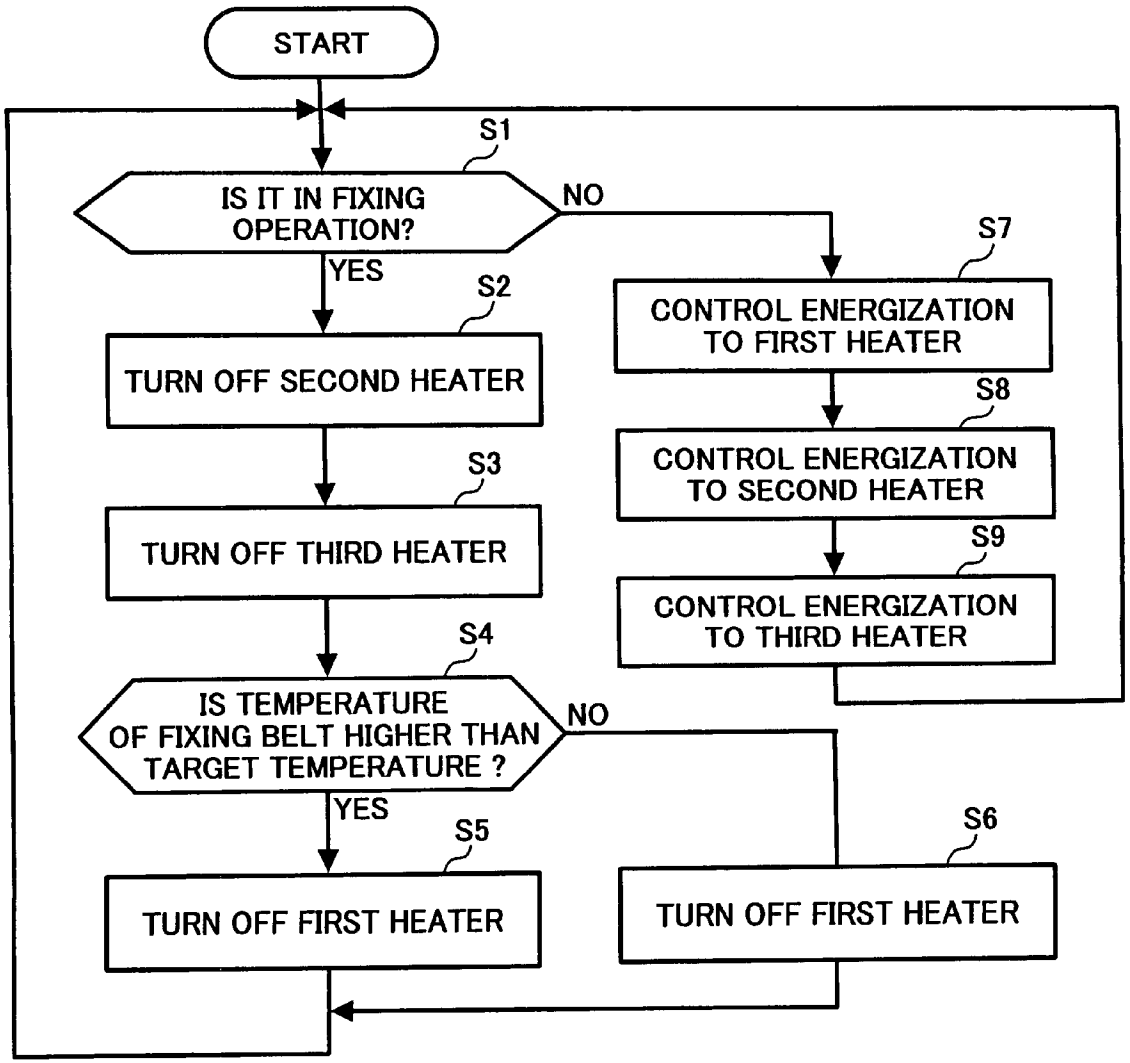
FIG. 3 is a flowchart of one example of controlling energization to a heater.

FIG. 3 is a flowchart of the operation example in the configuration described above. When the fixing apparatus is in the fixing operation (S1), power supply to the second heater 17 and the third heater 18 is turned off (S2, S3). When the temperature of the fixing belt 12 is equal to or higher than the target temperature (for example, 180° C.) at the time of fixing operation (S4), power supply to the first heater 16 is turned off (S5). When the temperature of the fixing belt 12 is lower than the target temperature at the time of fixing operation, the first heater 16 is energized (S6), to thereby control energization to the first heater 16. The power at the time of energization is controlled so as to be larger than the power supplied to the first heater 16 at the time of standby and at the time of startup operation, and preferably, the allowable all power is supplied to the first heater 16.

On the other hand, when the fixing apparatus is not in the fixing operation but in the startup operation or at the time of standby, energization to the first to third heaters 16, 17, and 18 is controlled (S7, S8, S9).

Before starting the startup operation of the fixing apparatus, the heating roller 15, the support roller 14, the facing roller 13, and the fixing belt 12 reach the ambient temperature. In this state, the startup operation is started, and generally, rotation of the heating roller 15, the support roller 14, the facing roller 13, and the fixing belt 12 is started in the middle of the startup operation. At this time, since the support roller 14 and the pressurizing roller 13 have a low thermal conductivity, it is difficult to warm these rollers 14 and 13 by the second and third heaters 17 and 18. Therefore, if the rollers 13, 14, and 15 and the fixing belt 12 start to rotate in the middle of the startup operation in a state in which the temperatures of the rollers 13 and 14 are still low, the heat of the fixing belt 12 is taken away by the facing roller 13 and the support roller 14, and hence, the temperature of the fixing belt 12 drops. As a result, the warm-up time required until the fixing belt 12 and the facing roller 13 reach the respective target temperatures at the time of fixing operation may be increased. On the other hand, at the time of standby, since the rollers 13, 14, and 15 and the fixing belt 12 are maintained at considerably high temperatures, much of the heat of the fixing belt 12 is not taken away by the facing roller 3 and the support roller 14 even when these rollers 13, 14, and 15 and the fixing belt 12 start rotation.

From this point of view, the fixing apparatus 2 in this example is configured such that the power supplied to the first heater 16 at the time of startup operation is set larger than the power supplied to the first heater 16 at the time of standby. With such a configuration, the temperature of the fixing belt 12 is raised quickly at the time of startup operation, and when the rollers 13, 14, and 15 and the fixing belt 12 start to rotate in the middle of the startup operation, the heat from the fixing belt 12 can be provided to the surfaces of the support roller 14 and the facing roller 13. At the time of startup operation, the support roller 14 and the facing roller 13 are heated from the inside thereof by the second and third heaters 17 and 18, and the surfaces of these rollers 14 and 13 can be heated by the fixing belt 12. As a result, the temperatures of these rollers 13 and 14 can be raised in a short period of time, thereby the warm-up time can be reduced.

At the time of fixing operation, the heat of the fixing belt 12 is taken away by a recording medium having better thermal conductivity than that of the elastic layers 24 and 26 of the support roller 14 and the facing roller 13. Therefore, if the heating value of the first heater 16 is not increased to a value than the value at the time of startup operation, it is difficult to keep the fixing belt 12 at the fixing temperature at the time of fixing operation. Therefore, in the fixing apparatus in this example, the power supplied to the first heater 16 at the time of fixing operation is set larger than the power supplied to the first heater 16 at the time of startup operation. More specifically, the power supply to the first heater 16 when the power to the first heater 16 is turned on at the time of fixing operation is set larger than the power supply to the first heater 16 when the power to the first heater 16 is turned on at the time of startup operation. As a result, the temperature of the fixing belt 12 can be kept at the fixing temperature more reliably during fixing operation, to thereby surely prevent faulty fixing of the toner image.

The image forming apparatus shown in FIG. 1 can select either a mode for transferring a single color toner image on the recording medium or a mode for transferring a composite toner image obtained by superposing toner images of a plurality of colors on the recording medium. However, if the amount of heat received by the composite toner image from the fixing apparatus 2 is small, gloss and coloring property of the image after fixation decreases, thereby the image quality deteriorates. Therefore, it is necessary to provide much more amount of heat to the toner image than the minimum amount of heat that can fix the composite toner image on the recording medium. On the other hand, when a single color toner image, particularly, a black toner image is to be fixed, no problem is caused in the gloss and coloring property even if the amount of heat to be provided thereto is more or less small. Thus, only the amount of heat that can fix the toner image is required.

From this point of view, the fixing apparatus in this example is configured so as to control energization to the first heater 16 such that the amount of heat to be provided to the recording medium of the same size is larger in the case where the toner image is the composite toner image as compared to the case where the toner image is the single color toner image. With this configuration, the quality of the image after fixing the composite toner image can be improved, and the energy consumption required for fixing the single color toner image can be suppressed.

In the respective configurations described above, if the power to be supplied to the first heater 16 is controlled by changing the ratio between the time when the heater 16 is energized and the time when the heater 16 is not energized, the supplied power can be accurately controlled. At the time of controlling the power supplied to the second and third heaters 17 and 18, the same method can be employed. More specifically, when the first to third heaters 16, 17, and 18 are respectively formed with a halogen heater, the heater must be energized for more than one second in order to input a rated voltage to the heater and set the rated power to be the effective power. Therefore, if on-off control of power supply to the heater is repeated with a certain interval within a time equal to or less than one second, the effective power can be made smaller than the rated power of the heater. In this manner, by changing the rate of the ON and OFF time of energization to the heater, desired effective power can be obtained. As a result, it is possible to change the minimum necessary amount of heat in the various modes, and therefore the power efficiency can be optimized.

Figure 4:
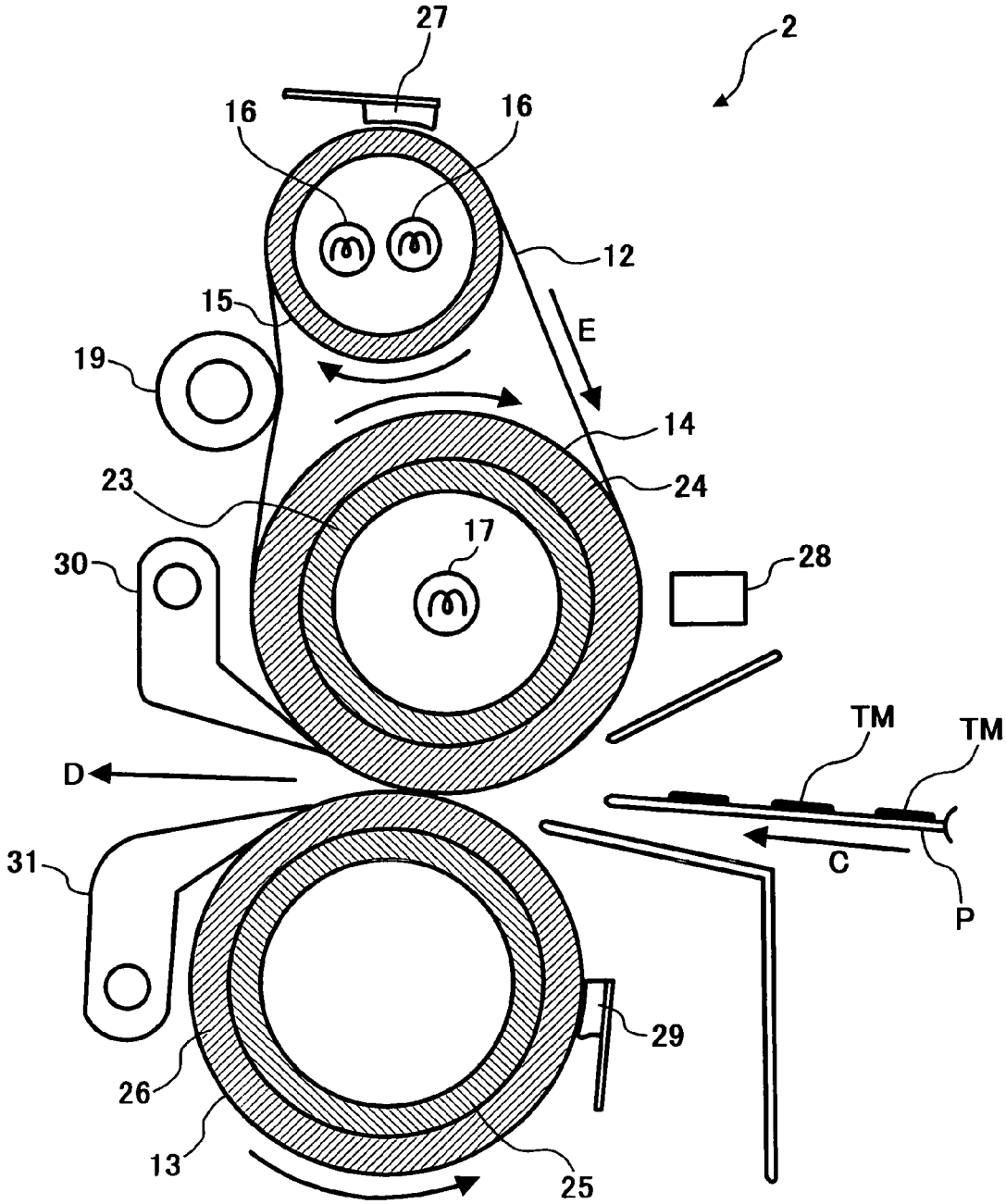
FIG. 4 is a cross section of another example of the fixing apparatus.
Figure 5:
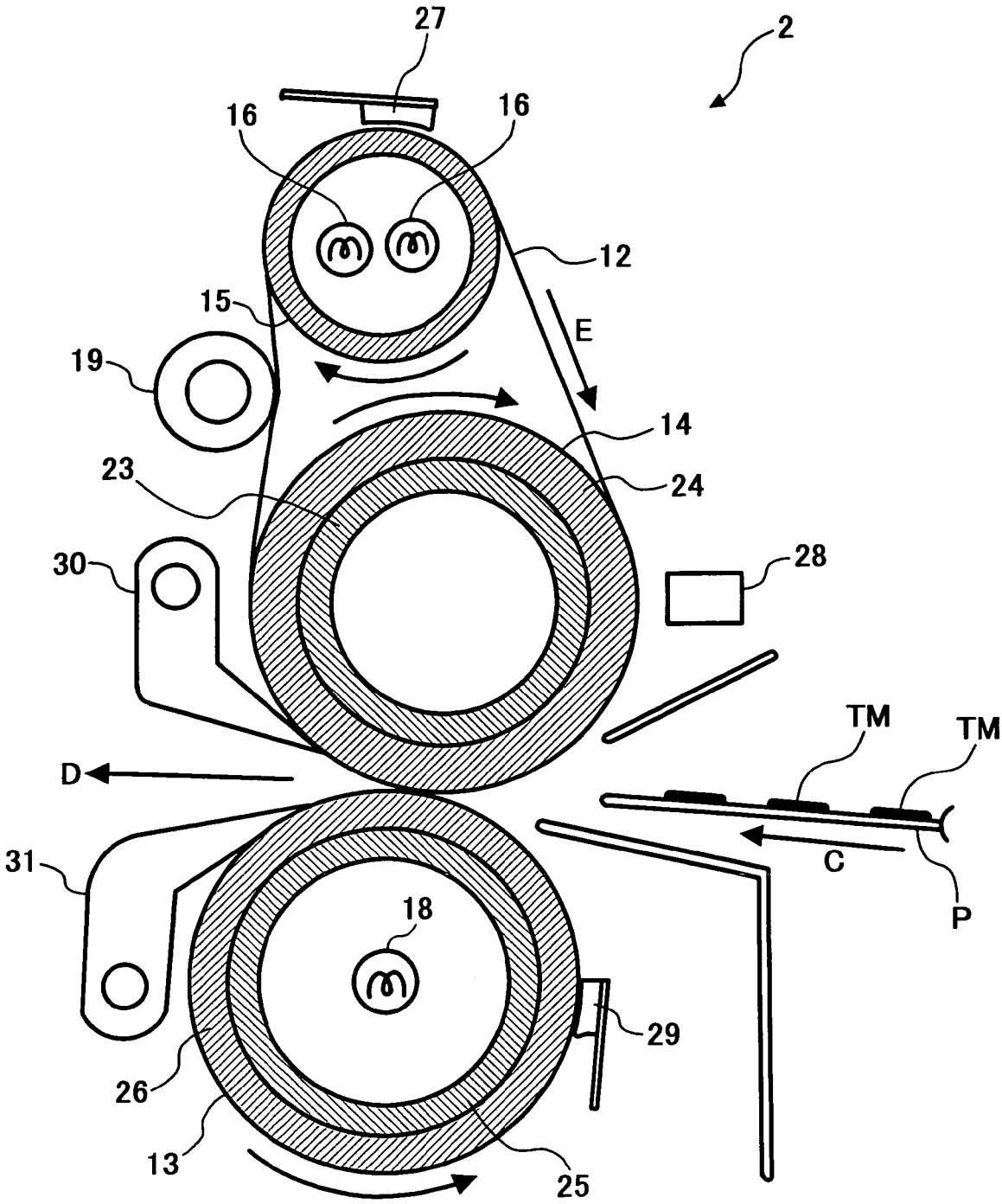
FIG. 5 is a cross section of still another example of the fixing apparatus.

In the fixing apparatus 2, the heaters 16, 17, and 18 are provided inside all of the heating roller 15, the support roller 14, and the facing roller 13, respectively. However, the respective configuration described above can be also employed in the case where the heaters are provided only in either the support roller 14 or the facing roller 13, and the heating roller 15. FIG. 4 shows an example in which the heater in the facing roller 13 is omitted, and FIG. 5 shows an example in which the heater in the support roller 14 is omitted. The rest of the configuration in the fixing apparatus 2 shown in FIG. 4 and FIG. 5 is the same as that of the fixing apparatus 2 shown in FIG. 1 and FIG. 3, and the same reference numerals are assigned to the same parts.

As described above, any of the configurations shown in FIG. 2, FIG. 4, and FIG. 5 can be adopted for the heaters. Assume that the heater arranged inside the heating member formed of the heating roller 15 is referred to as one heater, and that the heaters 17 and 18 arranged inside either the support member formed of the support roller 14 or the facing member formed of the facing roller 13, or arranged inside both the support member and the facing member are referred to as the other heater(s). Then, it is possible to employ the respective configurations for the fixing apparatus 2, and it is also possible to change a ratio between the power supplied to the other heaters 17 and 18 and the power supplied to the one heater 16. With such a configuration, it is possible to eliminate the defect, as in the conventional fixing apparatus, due to the case where the rate of power supplied to the respective heaters is constant at all times. At this time, the rate of the power supplied to the other heaters 17 and 18 can be decreased to be lower during the fixing operation as compared to that at the time of startup operation and standby, while the supply of power to the one heater 16 and to the other heaters 17 and 18 is maintained. Alternatively, no power may be supplied to the other heaters 17 and 18 during the fixing operation. With such a configuration, the similar effect to that of the examples described above can be exhibited. Further, in this case also, the average thermal conductivity of the heating member can be set larger than that of either the support member or the facing member in which the other heater is provided. Furthermore, the elastic layer may be provided on at least one surface side of the support member and the facing member, and the Young's modulus of the elastic layer can be set to be smaller than that of the heating member.

Figure 6:
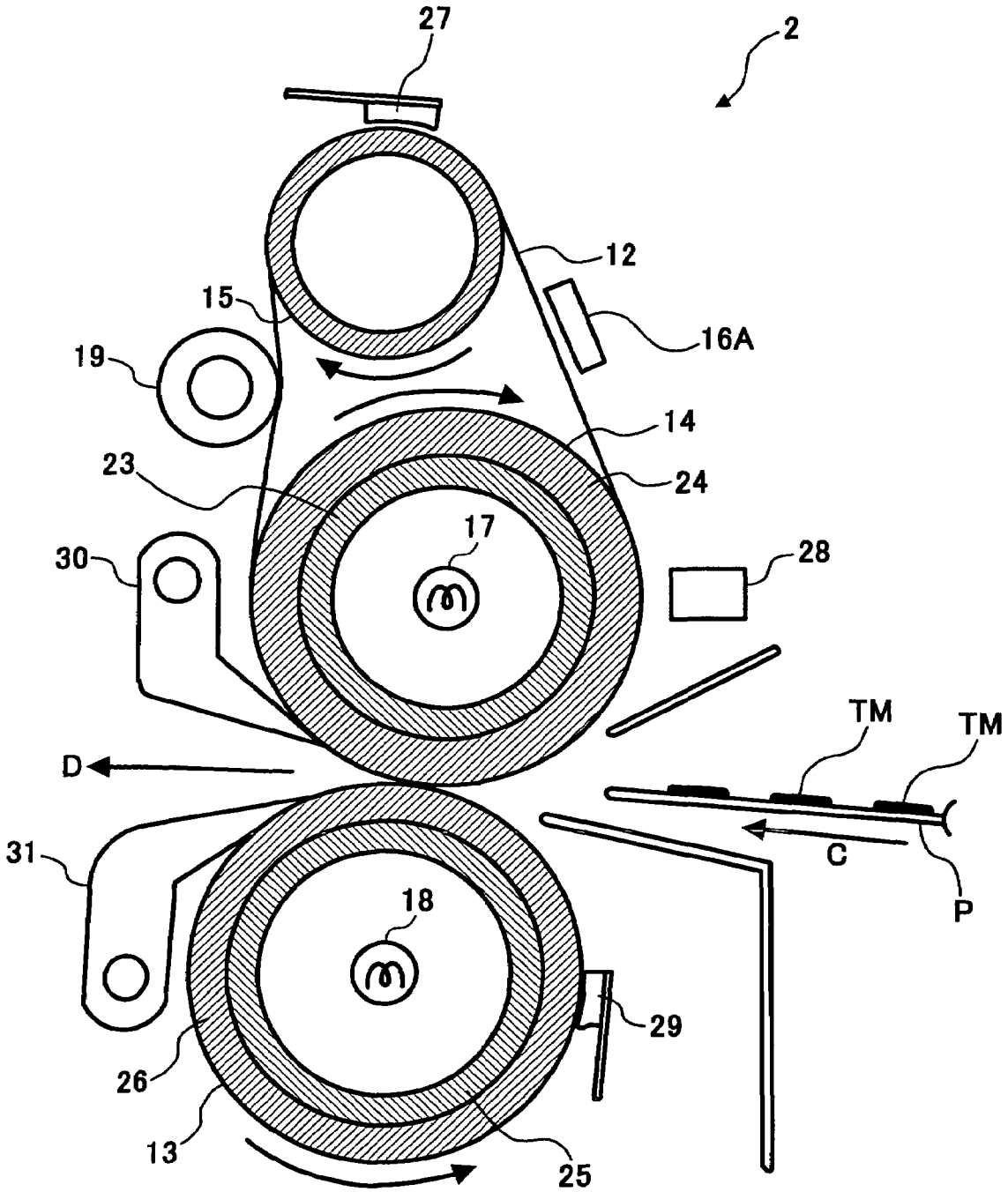
FIG. 6 is a cross section of still another example of the fixing apparatus.

As shown in FIG. 6, it is also possible to provide one heater 16A for heating the fixing belt 12, and to provide the other heaters 17 and 18 inside at least one of the support roller 14 and the facing roller 13. In the example shown in FIG. 6, the other heaters 17 and 18 are provided respectively inside both of the support roller 14 and the facing roller 13, but the other heater may be provided only in either one of the support roller 14 and the facing roller 13. In the example shown in FIG. 6, the heater is not provided in the roller 15, and hence the roller 15 does not serve as the heating roller, and only serves as a support roller for the fixing belt 12. The fixing belt 12 may be wound between those more than two support rollers. The rest of the configuration and effects of the fixing apparatus 2 shown in FIG. 6 are the same as those shown in FIG. 1 to FIG. 3, and the same reference numerals are assigned to the same parts.

As is obvious from the above, the fixing apparatus 2 may include the fixing belt 12 wound around between at least two support members (the rollers 14 and 15 of FIG. 6), the facing member (the facing roller 13 of FIG. 6) arranged so as to face the support member (the support roller 14 of FIG. 6) via the fixing belt 12, the one heater 16A for heating the fixing belt 12, and the other heaters 17 and 18 respectively arranged inside either the support member or the facing member, or arranged inside both of the support member and the facing member. In this case, the conventional defect can be eliminated by constructing the fixing apparatus such that the rate of power supplied to the other heaters 17 and 18 to the power supplied to the one heater 16A can be changed. In this case also, the rate of power supplied to the other heaters 17 and 18 can be decreased to be lower during the fixing operation than that at the time of startup operation and standby, while the supply of power to the one heater 16 and to the other heaters 17 and 18 is maintained. Alternatively, no power is supplied to the other heaters 17 and 18 during the fixing operation. With such a configuration, the similar effect to that of the examples described above with reference to FIG. 1 to FIG. 3 can be exhibited.

In FIG. 1, the example in which the fixing apparatus 2 is provided in the image forming apparatus that forms a color image is shown, but the present invention is also applicable to an image forming apparatus that mainly forms a single color image and a fixing apparatus for this image forming apparatus.

It has been mentioned above that the toner image is directly formed on the recording medium. However, it is not limited to this. The toner image may be first formed on a roller and then transferred on the recording medium.

It has been mentioned above that the toner image on the recording medium comes in contact with the fixing belt. However, it is not limited to this. The toner image may be formed on the facing roller 13.

According to the present invention, it is possible to obtain high quality images by preventing occurrence of faulty fixing of toner images.

The present document incorporates by reference the entire contents of Japanese priority documents, 2002-145508 filed in Japan on May 20,2002 and 2003-109535 filed in Japan on Apr. 14, 2003.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A fixing apparatus comprising:

a heating member;

a support member;

a fixing belt wound around between the heating member and the support member;

a facing member arranged so as to face the fixing belt;

a first heater that heats the heating member;

a second heater that heats the support member; and a third heater that heats the facing member, wherein a recording medium is passed through a nip portion between the facing member and the fixing belt that rotates, and a toner image is fixed on the recording medium by applying heat and pressure to toner on the toner image during the passage of the recording medium through the nip portion, wherein at the time of fixing operation, only the first heater is energized, of the first to third heaters, and all the first to third heaters are energized at the time of startup operation and during a standby state.

2. The fixing apparatus according to claim 1, wherein power supplied to the first heater at the time of startup operation is set larger than power supplied to the first heater during the standby state.

3. The fixing apparatus according to claim 1, wherein power supplied to the first heater at the time of fixing operation is set larger than power supplied to the first heater at the time of startup operation.

4. The fixing apparatus according to claim 1, wherein energization to the first heater is controlled such that an amount of heat to be provided to the recording medium of the same size is larger in a case where the toner image on the recording medium is a composite toner image obtained by superposing toner images of a plurality of colors on one another than in a case where the toner image is a single color toner image.

5. The fixing apparatus according to claim 1, wherein power to be supplied to the first heater is controlled by changing a ratio between a period of time when the first heater is energized and a period of time when the first heater is not energized.

6. The fixing apparatus according to claim 1, wherein the first heater is disposed inside the heating member, the second heater is disposed inside the support member, and the third heater is disposed inside the facing member, and an average thermal conductivity of the heating member is set larger than that of the support member and the facing member.

7. A fixing apparatus comprising:

a heating member;

a support member;

a fixing belt wound around between the heating member and the support member;

a facing member arranged so as to face the support member via the fixing belt;

a first heater disposed inside the heating member;

a second heater disposed inside either of the support member and the facing member, or disposed inside both of the support member and the facing member;

wherein a recording medium is passed through a nip portion between the facing member and the fixing belt that rotates, and a toner image is fixed on the recording medium by applying heat and pressure to toner on the toner image during the passage of the recording medium through the nip portion, wherein a rate of power supplied to the second heater with respect to power supplied to the first heater is configured to be changed by using on-off control of a heater power supply energized for a certain interval of time not more than one second.

8. The fixing apparatus according to claim 7, wherein the rate at the time of fixing operation is set to be smaller than that at the time of startup operation and during a standby state.

9. A fixing apparatus comprising:

a heating member;

a support member;

a fixing belt wound around between the heating member and the support member;

a facing member arranged so as to face the support member via the fixing belt;

a first heater disposed inside the heating member;

a second heater disposed inside either of the support member and the facing member, or disposed inside both of the support member and the facing member;

wherein an average thermal conductivity of the heating member is set larger than that of either one of the support member and the facing member in which the second heater is provided;

wherein a recording medium is passed through a nip portion between the facing member and the fixing belt that rotates, and a toner image is fixed on the recording medium by applying heat and pressure to toner on the toner image during the passage of the recording medium through the nip portion, wherein a rate of power supplied to the second heater with respect to power supplied to the first heater can be changed.

10. The fixing apparatus according to claim 9, wherein an elastic layer is provided on a surface of at least one of the support member and the facing member, and a Young's modulus of the elastic layer is set to be smaller than that of the heating member.

11. The fixing apparatus according to claim 9, wherein no power is supplied to the second heater at the time of fixing operation.

12. A fixing apparatus comprising:

a support member;

a fixing belt wound around between at least two support members;

a facing member arranged so as to face the support members via the fixing belt;

a first heater external to the support members that heats the fixing belt; and a second heater disposed inside either one of the support member and the facing member, or disposed inside both of the support member and the facing member, wherein a recording medium is passed through a nip portion between the facing member and the fixing belt that rotates, and a toner image is fixed on the recording medium by applying heat and pressure to toner on the toner image during the passage of the recording medium through the nip portion, wherein a rate of power supplied to the second heater with respect to power supplied to the first heater can be changed, wherein the rate at the time of fixing operation is set to be smaller than that at the time of startup operation and during a standby state.

13. A fixing apparatus comprising:

a support member;

a fixing belt wound around between at least two support members;

a facing member arranged so as to face the support members via the fixing belt;

a first heater external to the support members that heats the fixing belt; and a second heater disposed inside either one of the support member and the facing member, or disposed inside both of the support member and the facing member, wherein a recording medium is passed through a nip portion between the facing member and the fixing belt that rotates, and a toner image is fixed on the recording medium by applying heat and pressure to toner on the toner image during the passage of the recording medium through the nip portion, wherein a rate of power supplied to the second heater with respect to power supplied to the first heater can be changed, wherein no power is supplied to the second heater at the time of fixing operation.

14. An image forming apparatus comprising:

a fixing apparatus including a heating member;

a support member;

a fixing belt wound around between the heating member and the support member;

a facing member arranged so as to face the fixing belt;

a first heater that heats the heating member;

a second heater that heats the support member; and a third heater that heats the facing member, wherein a recording medium is passed through a nip portion between the facing member and the fixing belt that rotates, and a toner image is fixed on the recording medium by applying heat and pressure to toner on the toner image during the passage of the recording medium through the nip portion, wherein at the time of fixing operation, only the first heater is energized, of the first to third heaters, and all the first to third heaters are energized at the time of startup operation and during a standby state.

15. An image forming apparatus comprising:

a fixing apparatus including a heating member;

a support member;

a fixing belt wound around between the heating member and the support member;

a facing member arranged so as to face the support member via the fixing belt;

a first heater disposed inside the heating member;

a second heater disposed inside either of the support member and the facing member, or disposed inside both of the support member and the facing member;

wherein a recording medium is passed through a nip portion between the facing member and the fixing belt that rotates, and a toner image is fixed on the recording medium by applying heat and pressure to toner on the toner image during the passage of the recording medium through the nip portion, wherein a rate of power supplied to the second heater with respect to power supplied to the first heater is configured to be changed by using on-off control of a heater power supply energized for a certain interval of time not more than one second.

16. A fixing apparatus comprising:

a heating member;

a support member;

a fixing belt wound around between the heating member and the support member;

a facing member arranged so as to face the support member via the fixing belt;

a first heater disposed inside the heating member; and a second heater disposed inside either of the support member and the facing member, or disposed inside both of the support member and the facing member, wherein a recording medium is passed through a nip portion between the facing member and the fixing belt that rotates, and a toner image is fixed on the recording medium by applying heat and pressure to toner on the toner image during the passage of the recording medium through the nip portion, wherein each of an effective power of the first heater and the second heater is made smaller than a rated power of the first heater and the second heater, respectively, by on-off control of a power supply to each of the first heater and second heater.

17. A fixing apparatus comprising:

a heating member, a support member, a fixing belt wound between the heating member and the support member, a facing member arranged so as to face the support member via the fixing belt;

a first heater disposed inside the heating member; and a second heater disposed inside either of the support member and the facing member, or disposed inside both of the support member and the facing member, wherein a recording medium is passed through a nip portion between the facing member and the fixing belt that rotates, and a toner image is fixed on the recording medium by applying heat and pressure to toner on the toner image during the passage of the recording medium through the nip portion, wherein a rate of power supplied to the second heater with respect to power supplied to the first heater is controlled by on-off control of a heater power supply such that a rated power of the second heater is not reached during the on-off control.

18. An image forming apparatus comprising:

a fixing apparatus including a support member;

a fixing belt wound around between at least two support members;

a facing member arranged so as to face the support members via the fixing belt;

a first heater external of the support members that heats the fixing belt; and a second heater disposed inside either one of the support member and the facing member, or disposed inside both of the support member and the facing member, wherein a recording medium is passed through a nip portion between the facing member and the fixing belt that rotates, and a toner image is fixed on the recording medium by applying heat and pressure to toner on the toner image during the passage of the recording medium through the nip portion, wherein a rate of power supplied to the second heater to power supplied with respect to the first heater can be changed, and the rate at the time of a fixing operation is set to be smaller than that at the time of a startup operation and during a standby state.

19. An image forming apparatus comprising:

a fixing apparatus including a support member;

a fixing belt wound around between at least two support members;

a facing member arranged so as to face the support members via the fixing belt;

a first heater external of the support members that heats the fixing belt; and a second heater disposed inside either one of the support member and the facing member, or disposed inside both of the support member and the facing member, wherein a recording medium is passed through a nip portion between the facing member and the fixing belt that rotates, and a toner image is fixed on the recording medium by applying heat and pressure to toner on the toner image during the passage of the recording medium through the nip portion, wherein a rate of power supplied to the second heater to power supplied with respect to the first heater can be changed, and no power is supplied to the second heater at the time of fixing operation.

* * * * *

UNITED STATES PATENT AND TRADEMARK OFFICE

CERTIFICATE OF CORRECTION

PATENT NO. : 7,043,185 B2
APPLICATION NO. : 10/441006
DATED : May 9, 2006
INVENTOR(S) : Takahiro Yoshikawa It is certified that error appears in the above-identified patent and that said Letters Patent is hereby corrected as shown below:

Replace the sheet including Figure 3 with the attached sheet including Figure 3.

FIG. 3

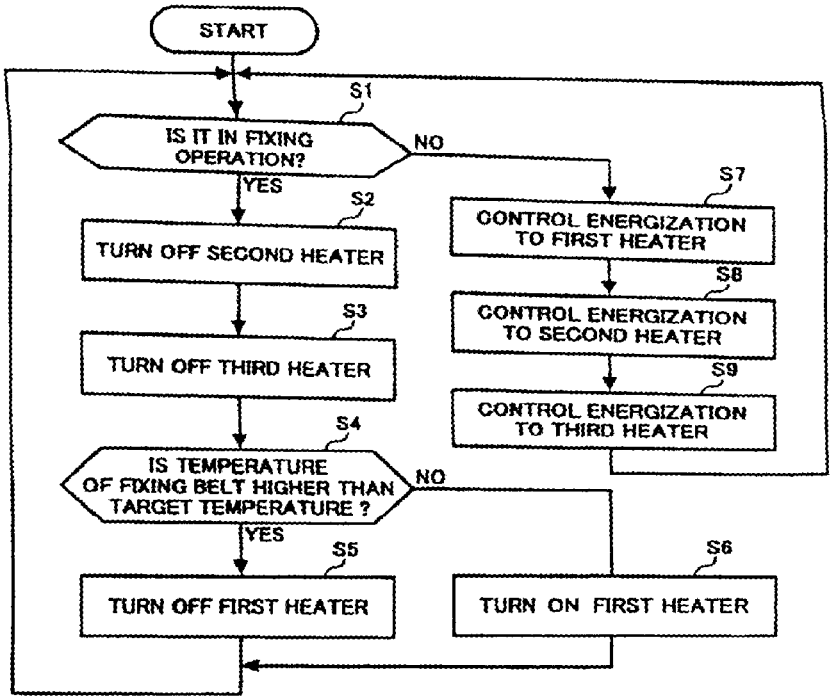

Signed and Sealed this

Sixth Day of May, 2008

JON W. DUDAS
*Director of the United States Patent and Trademark Office*